United States Patent [19]

Thomas

[11] Patent Number: 4,692,686

[45] Date of Patent: Sep. 8, 1987

[54] LOW-DISTORTION LINE VOLTAGE REGULATOR

[76] Inventor: Charles E. Thomas, P.O. Box 29109, New Orleans, La. 70189

[21] Appl. No.: 767,624

[22] Filed: Aug. 20, 1985

[51] Int. Cl.[4] ..... G05F 1/26

[52] U.S. Cl. ..... 323/263; 323/344; 363/101

[58] Field of Search ..... 323/259, 262, 263, 344; 363/101

[56] References Cited

U.S. PATENT DOCUMENTS

| | | | |
|---|---|---|---|
| 3,596,172 | 7/1971 | Harrison | 323/263 |
| 3,611,117 | 10/1971 | Schneider | 323/263 X |
| 3,614,595 | 10/1971 | Paulden | 323/344 |
| 4,178,539 | 12/1979 | Crapo | 323/263 X |
| 4,352,055 | 9/1982 | McCartney | 323/263 |

*Primary Examiner*—Peter S. Wong
*Attorney, Agent, or Firm*—Keaty & Keaty

[57] ABSTRACT

An AC voltage regulator maintains a predetermined, desired output voltage despite changes in the input voltage, the load, or other operating conditions. The regulator generates an AC reference voltage signal of the same frequency and in phase with the input voltage, and having an amplitude proportional to the predetermined, desired output voltage. The AC reference voltage signal is compared instantaneously to a portion of the actual output voltage to determine an error between the actual output voltage and the predetermined, desired output voltage. The error is instantaneously corrected by altering the actual output voltage to conform to the predetermined, desired output voltage.

17 Claims, 12 Drawing Figures

LOW-DISTORTION LINE VOLTAGE REGULATOR

BACKGROUND OF THE INVENTION

1. Field of the Invention

The present invention relates to a line voltage regulator, and more specifically to an AC variable voltage source using pulse width modulation techniques to drive boost and buck transformers such as to develop a controlled voltage output despite changes in the input voltage, the load or other operating conditions.

2. General discussion of the background.

The voltage from an unregulated source will invariably deviate from the ideal instantaneous and average values. Deviation may be present on the incoming voltage or it may be induced by loads. Deviation may take the form of (1) long-term variation of instantaneous and average voltage, (2) short-duration transients, and (3) harmonic distortion.

Many methods have been utilized in an attempt to provide controlled output voltage. Regulators utilizing boost and buck transformers are known in the prior art; such regulators have controlled the average value, rather than the instantaneous value, of AC output.

One type of average-controlling regulator is implemented by automatically switching boost and buck transformer taps so as to control their turns ratios. The switched-tap regulator provides output voltage control in discrete steps, the size of which is determined by the number of taps.

The present invention utilizes buck and boost transformers in such a manner that the output voltage is continuously controlled over the adjustment range.

It utilizes separate boost and buck transformers that are operated to alternately provide boost and buck. The frequency of alternation between boost and buck is much higher than the power frequency, which may be in the range of 50 to 400 hertz. In addition, the instantaneous value of output is controlled, rather than the average value.

The present invention utilizes bipolar transistors across the DC terminals of a bridge rectifier to switch to the boost or buck condition.

General state of the art teaches this basic AC switching scheme, which provides for the control of the boost and buck transformers in a different manner, so that the present state of the art appears to be applicable only to a single-phase circuits. For example, Harrison in his U.S. Pat. No. 3,596,172, does in fact regulate the AC voltage by utilizing switches, comprising bipolar transistor and rectifier to drive a single boost/buck transformer. An electronic circuit, as taught by Harrison, controls the average value of AC output voltage. It cannot control the instantaneous value so as to attenuate transients and harmonics. Harrison's device cannot synchronize switching frequency to the power frequency. Further, Harrison's device is only capable of controlling single-phase AC voltage.

Another disadvantage that can be attributed to Harrison's device is that the bipolar transistor base drive circuit is inadequate for transistors which switch at high frequency, since his circuit does not provide reverse-bias of the transistor collector-to-emittor-junction which is necessary for fast turn off.

Another example of the present state of the art is a patent issued to McCartney, U.S. Pat. No. 4,352,055, which utilizes field effect transistors (FET) as AC switches to control a single boost/buck transformer. McCartney teaches the use of a power transformer which provides boost and buck voltage sources and input-to-output isolation. The boost and buck sources are alternatively connected by the FET switches to the primary of the boost/buck transformer.

McCartney's device also suffers some major disadvantages. For example, it requires a power transformer to provide boost and buck voltage sources and to provide isolation between input and output. Further, field effect transistors utilized by McCartney have limited power handling capability. As was the case with Harrison, McCartney's electronic circuit controls the average value of AC output and cannot control the instantaneous value so as to actively attenuate transients and harmonics. McCartney's device cannot sychronize the switching frequency to the power frequency and it is capable of controlling only single-phase AC voltage.

SUMMARY OF THE INVENTION

The present invention solves the problems and eliminates shortcomings of the general state of the art exemplified above in a simple and straight forward manner. The present invention provides for a voltage regulator which utilizes pulse width modulation to provide regulated, transient-free, lower-distortion output voltage to sensitive equipment despite non-linear or switched loads or distorted input voltage. Such regulation is accomplished in accordance with the present invention by switching the primary windings of boost and buck transformers to generate boost/buck voltages in secondary windings of the two transformers. The transformer secondary windings are positioned in series between the voltage supply source and the output. The present invention provides for switching the boost and buck transformer primary windings in such a manner that output-to-input ratio is automatically controlled by feedback to maintain the instantaneous output at the desired value.

It is thus an object of the present invention to provide for a new and improved line voltage regulator.

It is a further object of the present invention to provide a power circuit which is capable of being controlled so as to actively attenuate transients and power-frequency harmonics.

It is still further object of the present invention to provide an electrical circuit capable of controlling the instantaneous value of AC output voltage so as to actively attenuate transients and harmonics.

It is a further object of the present invention to provide for an electrical circuit having switching frequency sychronized to the power frequency so as to prevent creation of "beat" frequencies which must be attenuated by filtering.

It is still a further object of the present invention to provide for an electrical circuit capable of controlling polyphase AC voltage.

It is another object of the present invention to provide for an electrical circuit having transistors which switch at high frequency.

It is still another object of the present invention to provide for a line voltage regulator having more power handling capability.

It is a further object of the present invention to provide for a line voltage regulator capable of controlling polyphase AC voltage.

It is a further object of the present invention to provide for a line voltage regulator capable of operating at power frequencies of 50, 60 or 400 hertz.

BRIEF DESCRIPTION OF THE DRAWINGS

The invention can be better understood by reference to the following drawings.

DETAILED DESCRIPTION OF THE PREFERRED EMBODIMENT

Figure 1:
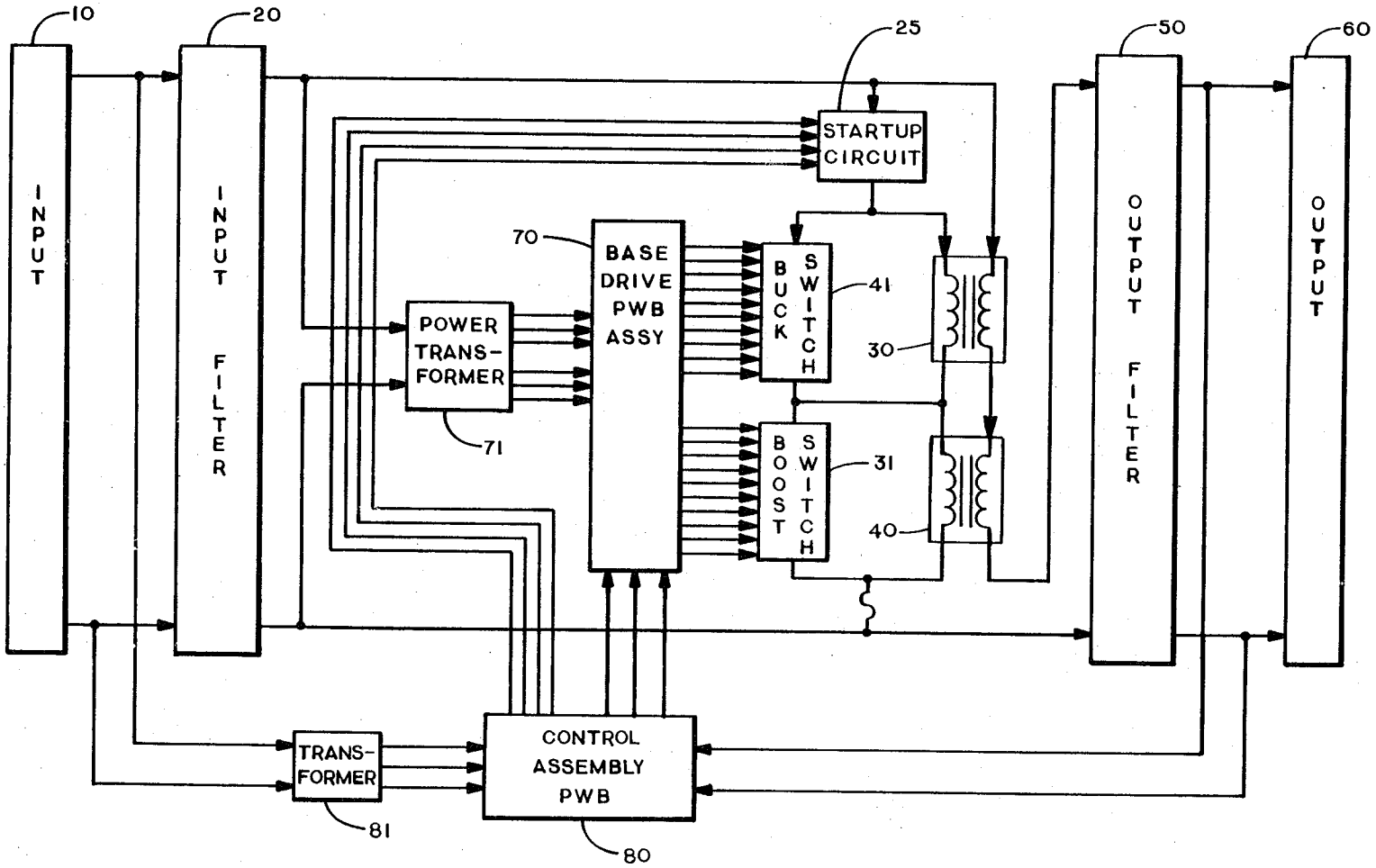
FIG. 1 is a schematic for the line voltage regulator system.
Figure 2:
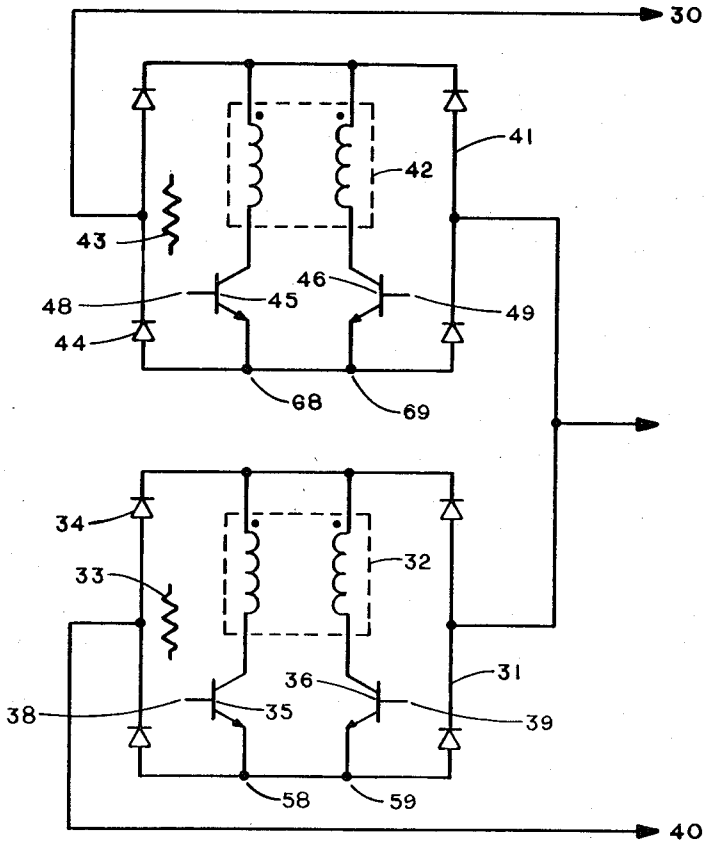
FIG. 2 is a boost and buck switch diagram in accordance with the present invention.

Referring now to FIGS. 1 and 2, the variable voltage source of the present invention utilizes an LVR input 10 (of 50 to 400 hertz). The LVR input 10 is then connected to the input filter 20 which is necessary to prevent any feedback to the source of the high frequency used in the designed circuit. The output of the input filter 20 is connected to the power transformers 71A and 71B necessary to supply power to the power supply of base drive PWB assembly 70, futher illustrated in FIG. 3. These power transformers 71A and 71B will convert the AC input voltage 10 to a low AC voltage which is necessary for the circuitry within the base drive PWB assembly 70.

The base drive PWB assembly 70 develops the required signals necessary to drive the bases 38, 39, 48, 49 of the transistors 35, 36, 45, 46 of the respective boost switch 31 or buck switch 41 in FIG. 2. The output of the input filter 20 is also connected in series with the secondary windings of boost transformer 30 and buck transformer 40 for the output to be properly regulated. Once the start-up circuit 25 causes the circuits to energize the transformers 30, 40, the secondary voltages of the transformers can be either added to or subtracted from the filtered input voltage 10 depending on what is required to maintain the desired output voltage 60.

This description covers a particular version of the line voltage regulator in which two power transistors 35 and 36, and 45 and 46 are, in effect, connected in parallel to increase the power handling capacity. Any number of transistors may be used as necessary to meet the requirements of particular applications.

Figure 4:
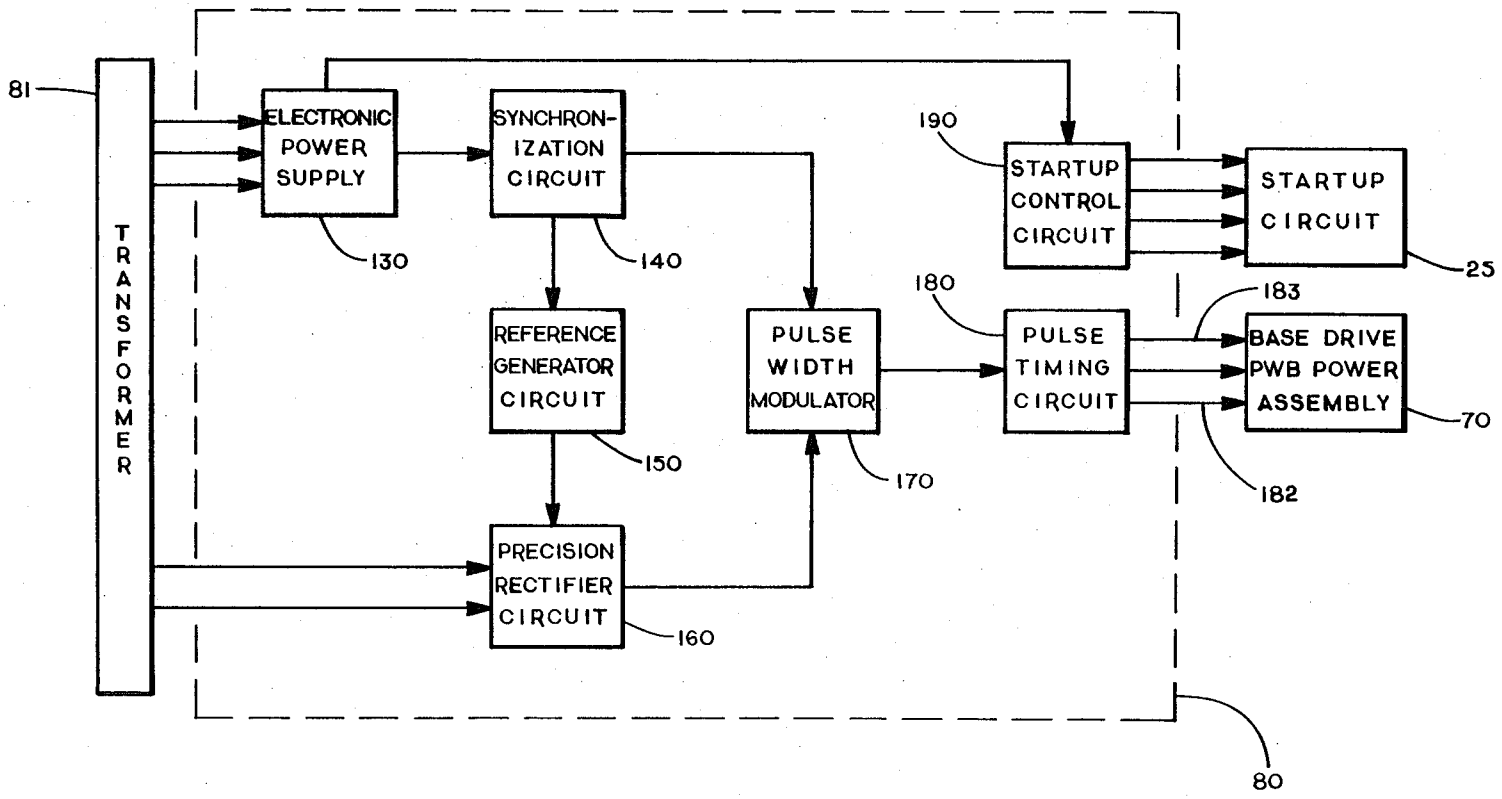
FIG. 4 is a schematic logic block diagram representing the control assembly PWB for the boost and buck signals.

The boost switch 31 or the buck switch 41, necessary to drive the primaries of transformers 30, 40 is activated at a rate of 20,000 to 48,000 cycles per second. The relative time that the circuit remains in boost or buck condition is determined by how many volts the system must add to or subtract from the input voltage 10. The output of control assembly PWB 80, FIG. 4, is fed into the base drive PWB assembly 70 so that the proper boost switch 31 or buck switch 41 is activated. Each switch, boost 31 or buck 41 consists of a snubber capacitor, snubber resistor 33, 43, a choke 32, 42, a bridge rectifier 34, 44 and two parallel transistors 35, 36 and 45, 46, all of which enable the switches 31, 41 to run efficiently at the high frequency the present invention circuit design requires.

The chokes 32, 42 enable operation in such a manner so as to prevent both switches 31, 41 to be "off" at the same time. For example, if the primary windings of both the boost transformer 30 and the buck transformer 40 were open at the same time because both switches 31, 41 were in "off" condition, the transformers 30, 40 would act as current transformers. Such a result from the transformers 30, 40 would create a very large voltage at their primary windings. The power transistors 35, 36, 45 and 46 are caused to be "on" simultaneously for a short period at transitions between the boost and buck conditions. During the period when all transistors are "on", the chokes 32 and 42 limit current simultaneous conduction. Chokes 32 and 42 also help to insure equal current through parallel transistors when they are turned on.

Figure 3:
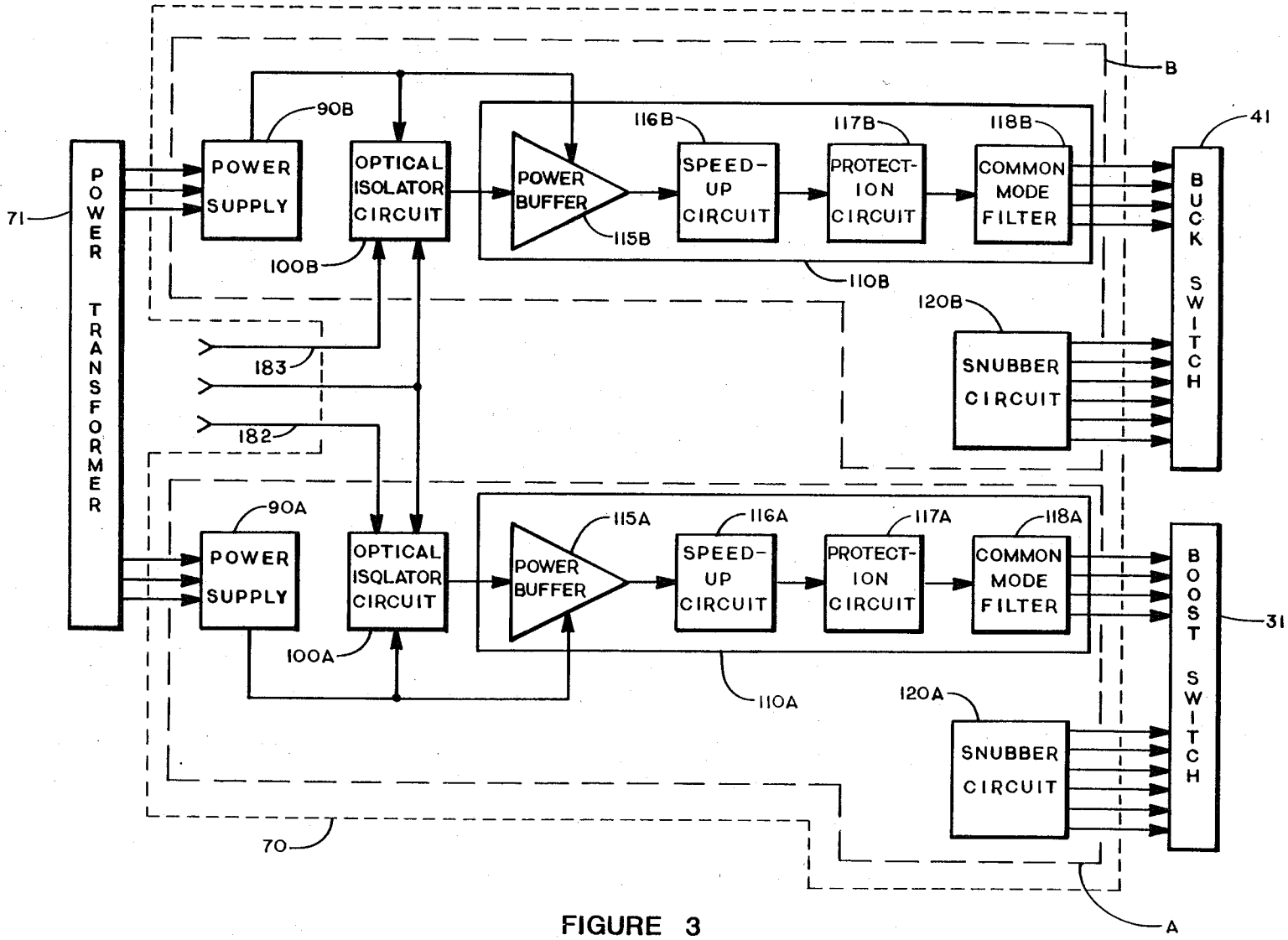
FIG. 3 is a schematic logic diagram representing the transistor base drive circuits for the boost and buck switches of FIG. 1.

The snubber resistors 33, 43 and the bridge rectifiers 34, 44 are discussed in more detail in description of FIG. 3. Briefly, the snubber resistor 33, 43 is used to dissipate any excess voltage that may develop from the circuit inductances whenever rapid current changes occur in the circuitry. The bridge rectifiers 34, 44 provide the DC output that is necessary for the transistors 35, 36, 45 and 46.

The control assembly PWB 80, as illustrated in FIG. 4, transmits the value of the boost/buck signal, developed therein to determine how long the boost or buck switch 31, 41 will have to remain "on" or "off", to the base drive PWB assembly 70. The boost signal 182 and buck signal 183, developed, are transmitted to the base drive PWB assembly 70 which subsequently functions to send the necessary power to drive the transistors 35, 36 within the boost switch 31 or 45, 46 within the buck switch 41, depending on whichever is to be activated at that time.

Only one switch 31, 41 can be "on" at any one time, except during transitions. When one switch 31, 41 is opened, the other switch 31, 41 will close and short the primary terminals at its respective transformer 30, 40, so that transformer will possess a voltage drop at the secondary voltage to equal zero. The primary of transformer 30, 40 which is not shortened by switch 31, 41 will create a secondary voltage that will be added to or subtracted from the input voltage 10. If it is the boost transformer 30 that is active because the boost switch 31 has received power from the base drive PWB assembly 70, then voltage is added to the input voltage 10 to keep the output voltage 60 continually at the desired value. On the other hand, however, if the buck transformer 40 is active, then voltage will be subtracted from the input voltage 10 to keep output voltage 60 at the desired value.

Prior to the voltage being transmitted to the load, the regulated input voltage 10 is passed through an output filter 50. The output filter 50 is used to attenuate the high frequency that generated by the present invention circuitry. The output voltage 60 filtered through the output filter 50 will be the desired, controlled instantaneous output voltage. The present invention circuitry enables the output voltage to remain at the desired value despite any changes in the load or operating conditions of the circuitry or distortions from the input voltage 10 or any number of other factors.

Referring now to FIG. 3, a more detailed description of the base drive PWB assembly 70, of FIG. 1, necessary to drive the transistors 35, 36, 45, 46 of the switches 31, 41 of FIG. 2 is illustrated. FIG. 3 shows two separate identical circuits where circuit A is the circuitry required for the boost switch 31 (FIG. 1), and circuit B is the circuitry required to activate the buck switch 41, FIG. 1. For simplicity, only one circuit, A, the circuitry required to control the boost switch 31, FIG. 1, will be described. Nonetheless, everything described in the implementation of circuit A, in FIG. 3 is exactly the same as of circuit B.

The two circuits, A and B, have been developed to amplify the power of the boost signal 182, and the buck signal 183. Since the boost signal 182 and the buck signal 183 came from low power electronic devices, they do not have enough power to drive the transistors 35, 36, 45, 46 of boost switch 31 and buck switch 41 in FIG. 2.

The input to the power supply 90A is the AC voltage that was provided at the secondary terminals of the power transformer 70A in FIG. 1. The power supply 90A will provide a DC voltage supply which is equal to +7 and −7 volts. This +7 and −7 voltage is used to power all of the circuitry within the circuit A of FIG. 3, the assembly sending the power signal to drive the bases of the transistors 35, 36 of the boost switch 31, of FIG. 2.

The optical isolator circuit 100A is necessary for base drive PWB assembly 70 since it is controlled by boost signal 182, FIG. 4 which is generated using the electronic power supply 130 in FIG. 4 instead of base drive power supply 90A. The optical isolator 100A is used to isolate the transmitted boost signal 182 so it will not be affected by the high common mode voltage of base drive power supply 90A, FIG. 3.

The signal from optical isolator circuit 100A, which has been properly developed, must now be sent to the boost switch 31, FIG. 1, if voltage is required to be added to the input voltage 10, FIG. 1. Consequently, this signal is transmitted to the power transistor base drive circuit 110A which essentially supplies the power to the bases of transistors 35, 36, FIG. 2 of the boost switch 31, FIG. 1, when the boost switch 31 is to be active. The output of optical isolator 100A now is applied to a power buffer 115A, which amplifies the power of boost signal from optical isolator 100A so that it can drive the transistors 35, 36 of boost switch 31 in FIG. 2. The present invention circuit separates the buffer into two parts to develop the two separate power signals necessary to drive the bases of each of the two parallel transistors 35, 36 of the boost switch 31 in FIG. 2.

The power buffer 115A output is then passed to the speed up circuit 116A FIG. 3, which contains pairs of capacitors and resistors in parallel, (not shown). Separate pairs of capacitors and resistors in parallel are used to ensure that the output current of each aplifier in power buffer 115A is equal. This is necessary so that the bases of two transistors 35, 36 of the boost switch 31 will receive exactly the same current signals. The addition of thespeed-up circuit 116Ak of course, enables to speed up the switching time of boost switch 31, FIG. 1, from "on" to "off" positions or reverse.

The power signal from speed-up circuit 116A is further applied to protection circuit 117A, FIG. 3. The protection circuit 117A is designed to prevent the possibility of the high voltage, which may occur due to transistor failure due to transistor failure between the base 38, FIG. 2, and emitter 35, FIG. 2, of the transistor 35 located in the boost switch 31, FIG. 1, from being carried back through the base drive circuitry. Protection of the circuit is achieved through the use of a zener diode (not shown). The zener diode will conduct a large current whenever an abnormally high voltage is transmitted across it, that will cause the fuse in the protection circuit (not shown) to open. The current, will thus prevent any voltage from being carried back through the circuitry of the base drive PWB assembly 70. Before the power signal is transmitted to the bases 38, 39 of the transistors 35, 36 of the boost switch 31, the signal is passed through a common mode filter 118A. The common mode filter 118A is designed to attenuate any noise that may develop on the signal due to the fact that the circuit is switching at very high rates. The common mode filter 118A functions to present a very low impedance to any signal wanted to be passed and creates a high impedance to those that are not desired. Accordingly, the result is an output signal to be transmitted to the transistors 34, 35 of the switch 31 which is free from any unwanted noise.

The base drive PWB assembly 70 sends power alternatively between the boost switch 31 and buck switch 41 every 1/20,000 seconds to 1/48,000 seconds and which depends on switching frequency developed in control assembly PWB 80, FIG. 4. Therefore, when switch 31 is "off", the transistors 35, 36 should appear as open circuits so that no current flows across. Nonetheless, due to energy stored in circuit inductance, there is a desire within the circuitry to have a continually flowing current. The snubber circuit 120A, FIG. 3 is necessary to dissipate the energy which is stored in the snubber inductance, when the transistors 35, 36 of the boost switch 31 are switched off. This snubber capacitor voltage is discharged back through transistors 35, 36 so the snubber capacitor will be able to accept the energy when the switch 31 is again in an open position and no voltage should be sent across the boost transformer 30. However, the snubber capacitor may not discharge sufficiently through transistor 35, 36 thus, the present invention circuitry employs the use of another resistor 33, FIG. 2, connected in parallel to the capacitor to continually dissipate the energy.

Referring now to FIG. 4, the control assembly PWB 80 which creates the boost signal 182 and buck signal 183 which determines how much correction is required for the input voltage 10, FIG. 1 so that the desired output voltage 60 is maintained. The control assembly PWB 80 is designed to compare a portion of the instantaneous output voltage 60 to a reference signal 161, FIG. 6, to determine any difference which would require the boosting or buckig of the circuit. The control assembly PWB 80, FIG. 4, is powered by an electronic power supply 130 which converts from AC power, which is supplied by transformer 81, to DC power since DC power is necessary for all the circuitry. Additionally, the control assembly PWB 80 employs a synchronization circuit 140. Since the present invention circuit design seeks to alleviate any distortion including that due to "beat" frequency at the output voltage 60, such a synchronization circuit 140 is essential to ensure that all the elements of the circuit design are synchronized. The input voltage 10 or a voltage of the same frequency and phase is applied to the synchronization circuit to enable the rest of the elements within within the circuit to be synchronized to the frequency of the input voltage 10. One output from the synchronization circuit 140 will provide a pulse to the synchronization pin of pulse width modulator 170 which is an integral multiple frequency of the input voltage 10. The other output of the synchronization circuit provides the square wave that is applied to the digital filter 151, FIG. 5, and which is also an integral multiple frequency of input voltage 10.

The present invention, rather than measuring output error at an average rate does so instantaneously, and thus the circuit design utilizes an instantaneous reference signal 161, to be compared to a portion of the instantaneous output voltage 60, to assess any errors or distortions that may be present. The feedback signal 162 of instantaneous output voltage 60 is designed to follow the reference signal 161 point for point. Therefore, the reference signal 161 must always be in phase with the sine wave input voltage 10 so that the desired output voltage 60, is also in phase with the input voltage 10. Additionally, the reference signal 161, developed, must be free for distortions so that when the output voltage 60 is regulated precisely from the reference signal 161, it too will have no unwanted distortion.

Figure 5:
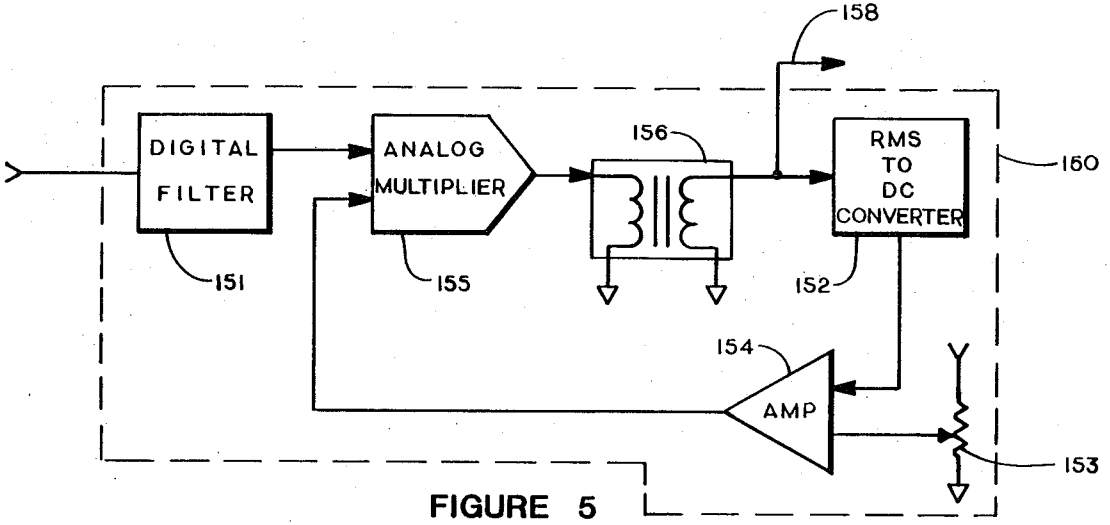
FIG. 5 is a reference generator circuit of the present invention.

Since the reference signal 161 is supplied by reference voltage output 158, FIG. 5 through the potentiometer 169A, therefore the reference voltage output 158 must also be in phase with input voltage 10 as well as free of harmonic distortion. In order to generate the reference voltage output 158 with such characteristics as above, the low level voltage of input voltage 10 is first passed through a digital filter 151, FIG. 5. The digital filter is a switching capacitor filter and its output ensures that the input signal is free from all unwanted or unexpected harmonic distortions.

In creating the reference voltage output 158, the output from the digital filter 151 is applied to analog multiplier 155 to achieve a reference voltage that has the specifically desired amplitude. The inputs to the analog multiplier 155 are the distortion-free signals from output of the digital filter 151 and the output of amplifer 154, FIG. 5. The output of the amplifier 154 is essentially the feedback from reference voltage output 158, and it is created by comparing the DC reference voltage of potentiometer 153 with the output of the precision RMS to DC converter 152, which in essence is the average value of reference voltage output 158. Since the inputs to multiplier 155 are a DC signal and distortion free AC signal, therefore its output is also to be free from distortion.

The output of multiplier 155 is then passed through the transformer 156 to remove any DC offset that may be present in the output of multiplier 155 and attain the proper reference voltage output 158. The transformer 156 is very necessary in the circuitry to correct the DC offset that could occur at the output of multiplier 155. Therefore, the reference voltage output 158 is now not only free from distortions, but also precisely regulated and contains no DC voltage which may cause unbalance of the output voltage 60.

Figure 6:
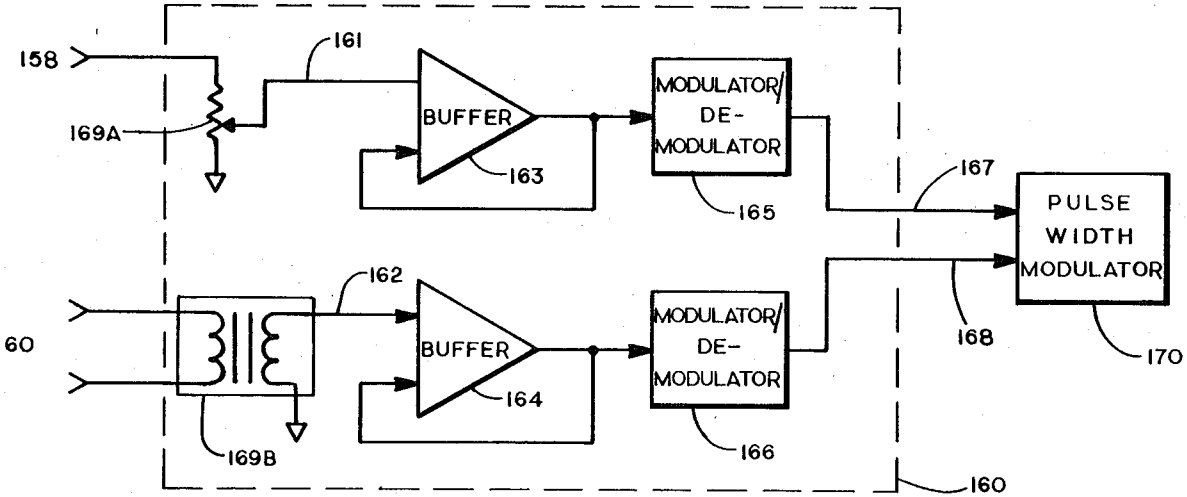
FIG. 6 is a precision rectifier circuit of the present invention.
Figure 9:
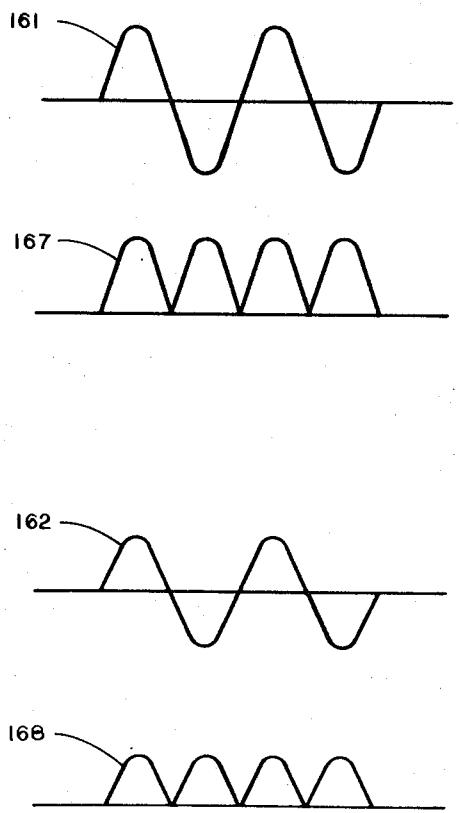
FIG. 9 is a diagram of the signals that are input into thepulse width modulator to determine the error between the instantaneous reference voltage and instantaneous output voltage.
Figure 10:
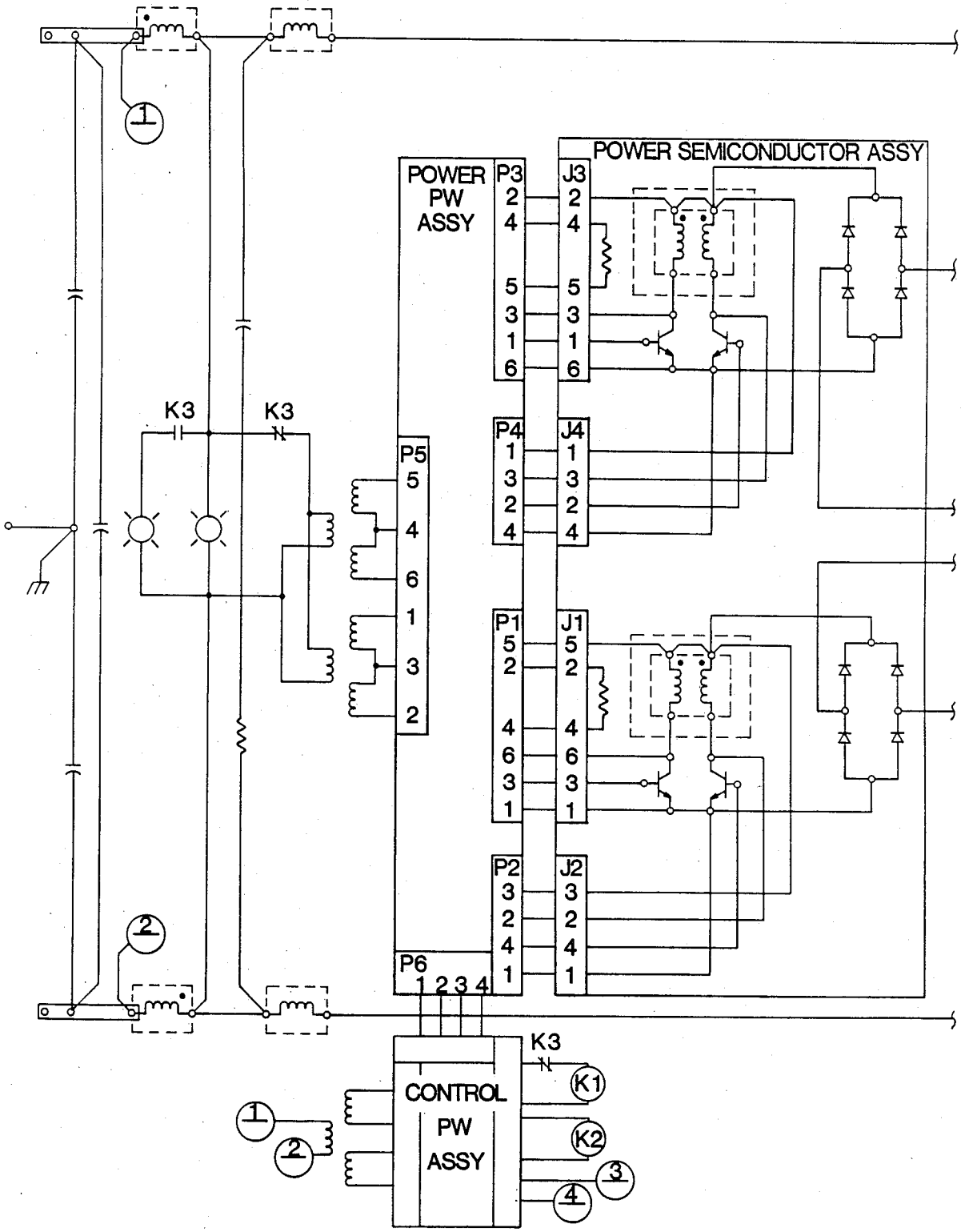
FIG. 10 is a schematic electrical diagram of the line voltage regulator of the present invention.
Figure 10:
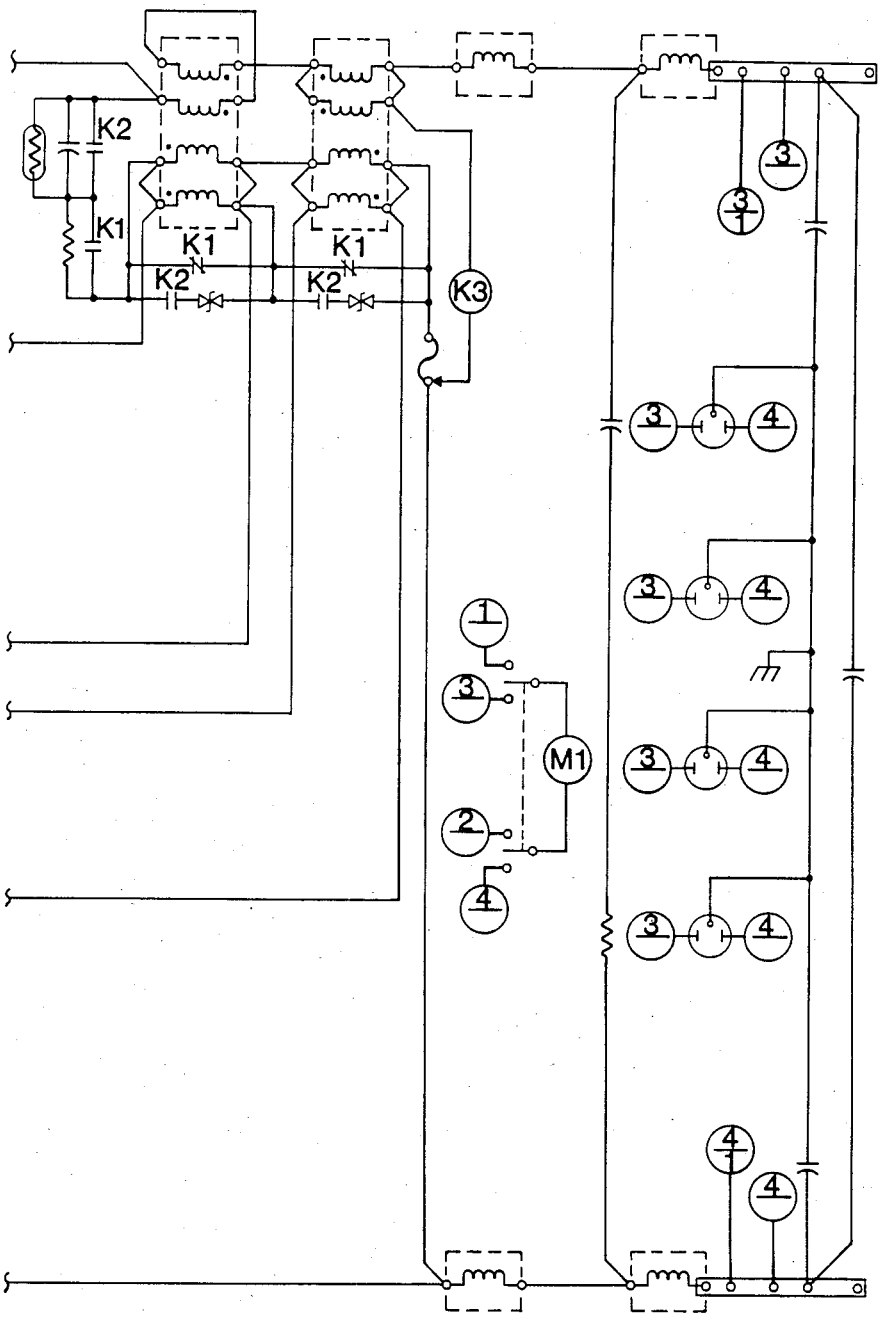
Figure 11:
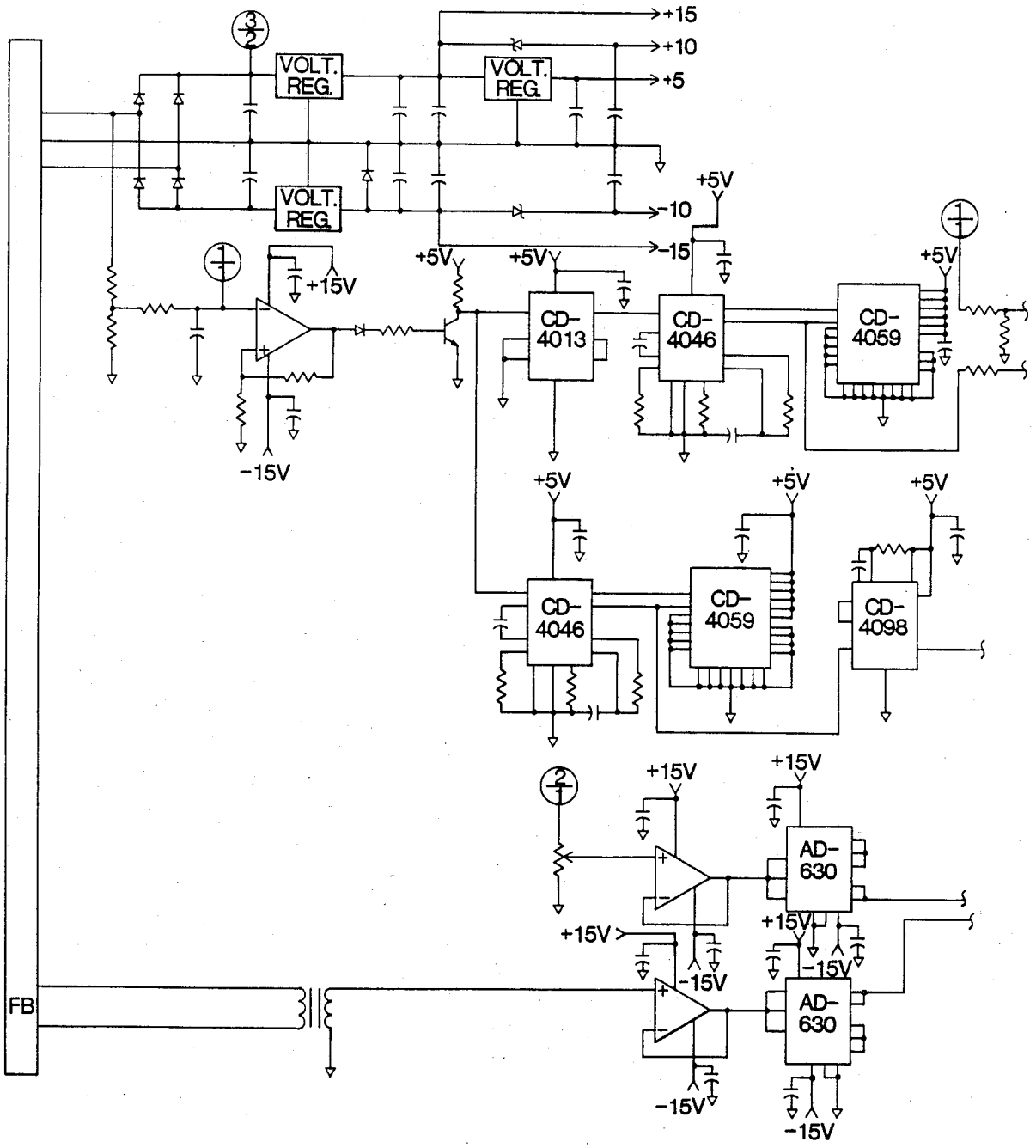
FIG. 11 is an electrical circuit diagram of the control assembly PWB of the voltage regulator of the present invention.
Figure 11:
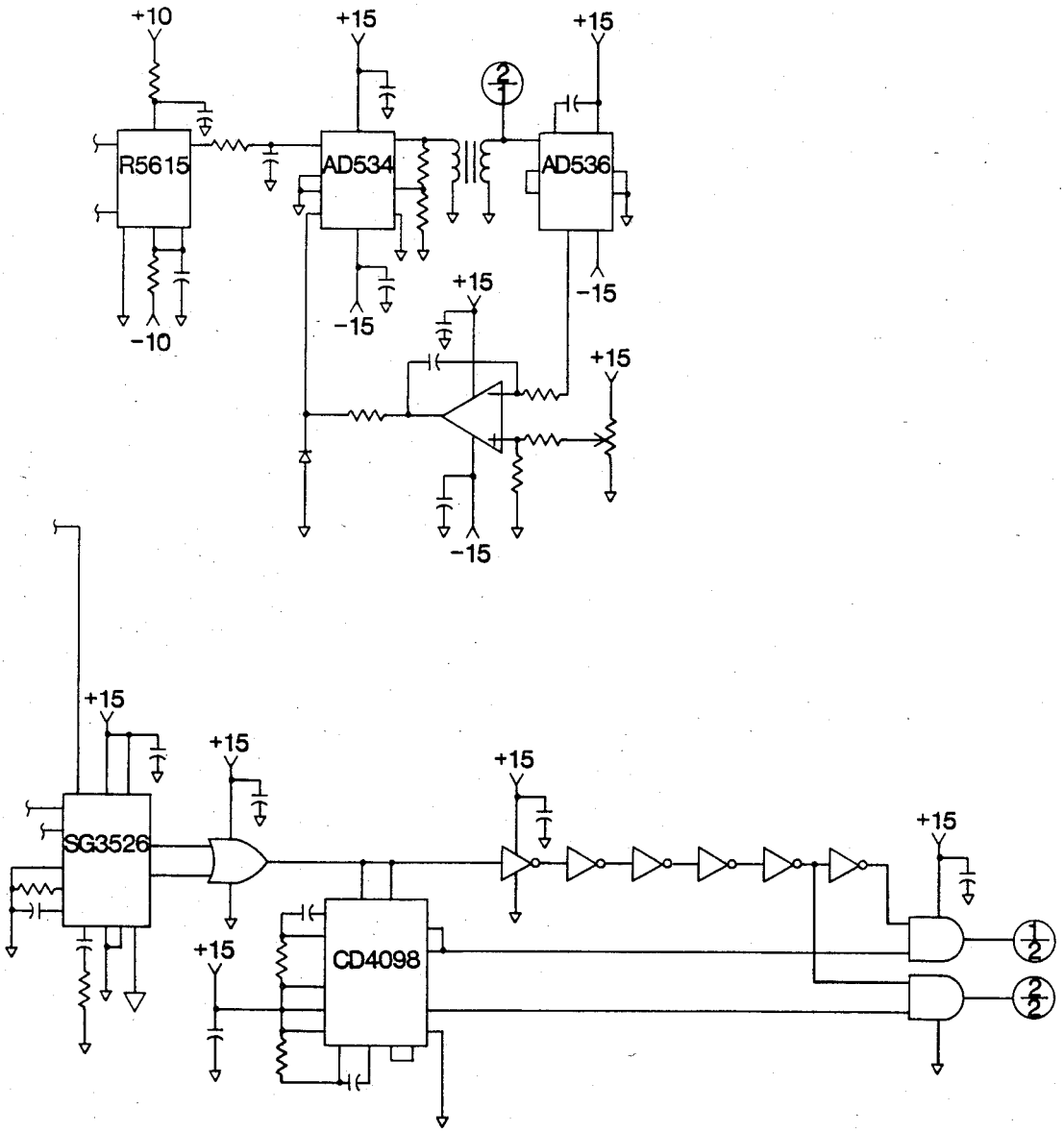
Figure 12:
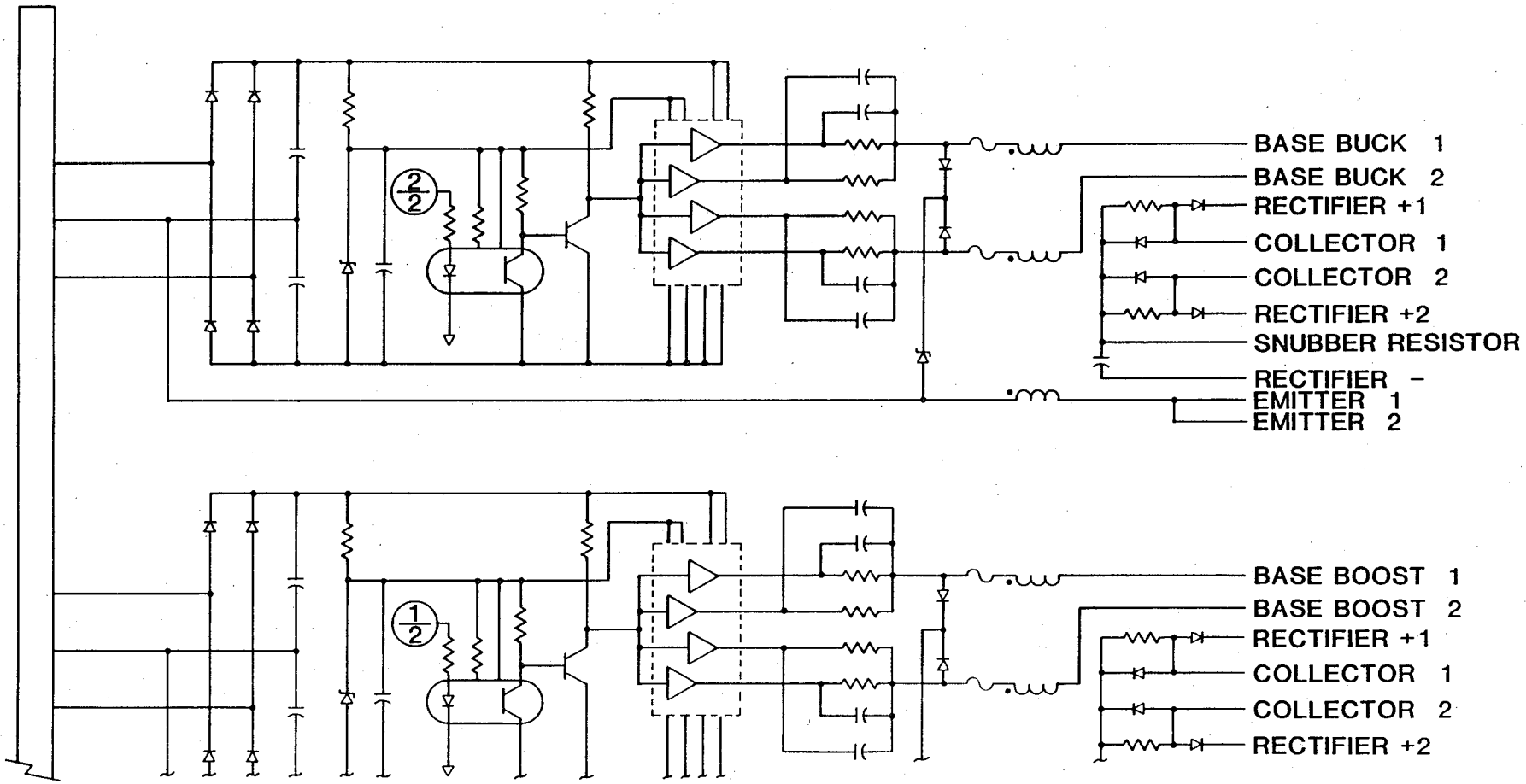
FIG. 12 is a schematic logic diagram of the power transistor base drive circuits for the boost and buck switches of the voltage regulator of FIG. 10.
Figure 12:
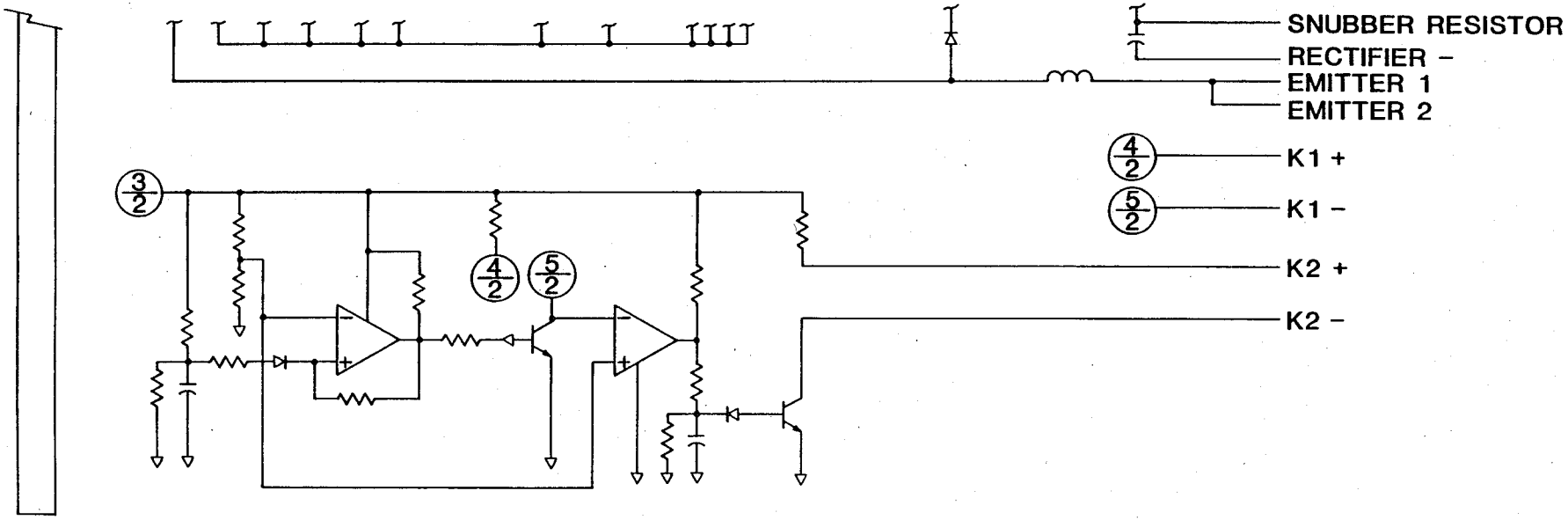

Before the reference signal 161 and output voltage feedback can feed into the pulse width modulator 170 for point-to-point comparison, they must pass through the precision rectifier circuit 160, FIG. 4, because pulse width modulator can not accept AC signals. The precision rectifier circuit will take the output voltage feedback to convert it to the feedback signal 162, FIG. 6, which is a low level voltage usable in the electronic circuit, through the transformer 169B, FIG. 6. Since the input impedance of modulator/demodulators 165, 166, FIG. 6, is low, the reference signal 161 and the feedback signal 162 must go through the buffers 163, 164 to avoid the major affects such as distortion and phase shift. The outputs of the precision rectifier circuit 160 for both the reference signal 161 and the feedback signal 162, can now be compared since it converts the AC signals 161 and 162 to the DC signals 167 and 168, respectively; signals 161, 162, 167, and 168 are shown in FIG. 9. These specific outputs of FIG. 9 are essential to the present invention circuit design. These outputs enable the instantaneous waveforms of the reference signal 167 and output feedback signal 168 to be input into the pulse width modulator 170 in FIG. 4. As a result, the pulse width modulator can ascertain the instantaneous error at each point rather than the average error.

Figure 7:
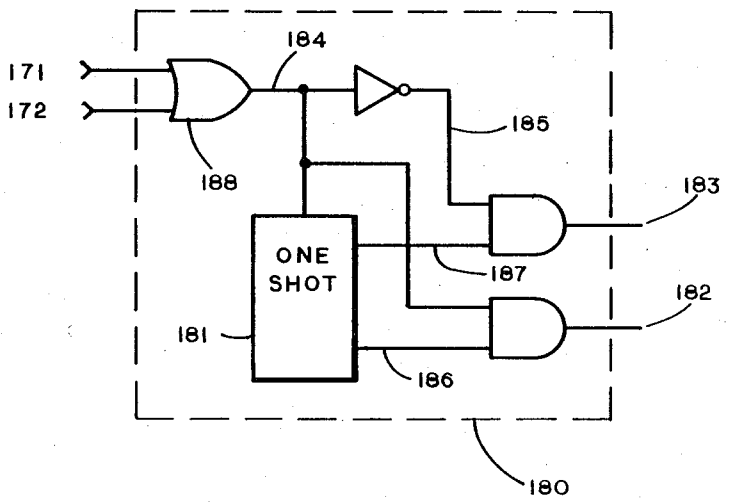
FIG. 7 is a pulse-timing circuit diagram.

The pulse width modulator 170 compars the exact reference signal 167 to the exact instantaneous output feedback signal 168, at each point in time, to create a pulse with duration related to any error between the two signals 167, 168, which is truly accurate. The duration of the pulse representing the error can be anywhere from 0 to 1/24,000 seconds if the switching frequency is at 24 kz. In order to obtain the pulse to represent the signal that will drive the boost switch 31, FIG. 1, two outputs of PWM 170 must be applied to the "OR" gate 188 which is shown in the pulse-timing circuits of FIG. 7. The complement signal 185 of signal 184, FIG. 7, which comes from "OR" gate 188, will be the signal to drive buck switch 41 of FIG. 1.

Due to the fact, however, that the time required to turn the transistors 35, 36, 45, 46 "on" and "off" is not the same, the present invention provides a pulse-timing circuit 180, FIG. 4, to provide a time delay for the signal that turns on the transistors 35, 36, 45, 46 in FIG. 2. The time delay is achieved by the one-shot 181, FIG. 7. The one-shot 181 receives the signal 184, which is the output of "OR" gate 188, to generate two pulse wave forms, which are the signals 186, 187 in FIG. 7.

Figure 8:
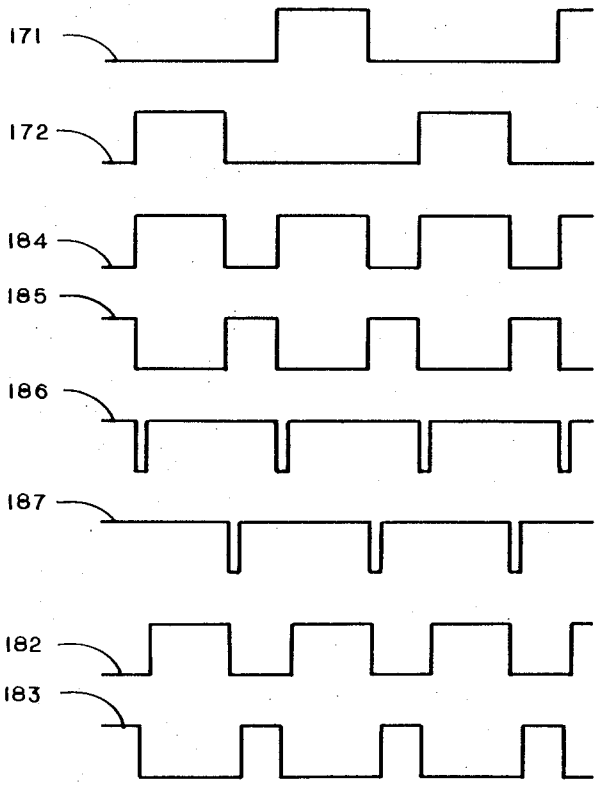
FIG. 8 is a timing diagram of pulse-timing circuit.

The pulse duration of each wave form represents the time delay that is necessary for transistors 35, 36, 45, 46 of FIG. 2. Once the boost and buck signals 182, 183 have been properly developed to respond to the error of output voltage 60, FIG. 1, they are transmitted to the base drive PWB assembly 70 so that the necessary power can be sent to the boost switch 31 or the buck switch 41, depending on which switch is to be activated. All the waveforms coming in and out from pulse-timing circuit are illustrated in FIG. 8.

Finally, the control assembly PWB 80 also contains the start-up control circuit 190, FIG. 4. This circuit was developed to control the start-up circuit 25, as soon as the signals coming out from control 80 reach steady-state conditions. This start-up control circuit avoids large transient currents and voltages that occur when input voltage 10 is suddenly applied.

It is clear to those skilled in the art that the present invention is capable of controlling the instantaneous value of output because switching of the boost and buck transformer primary windings occurs at a frequency (20 kilohertz to 48 kilohertz) which is much higher than the power frequency (50 to 400 hertz). Additionally, the instantaneous value of output is measured and caused to conform to a sine wave reference signal generated within the regulator.

The present invention also allows creation of a precisely regulated, low distortion output because the instantaneous, rather than average, value of output voltage is regulated, the regulator generates minimum low-order harmonics of the power frequency and the output filter impedance is negligible to low-order harmonics of the power frequency. The electrical circuit of the present invention also includes a high frequency switching circuit which alternately connects the primary windings of the boost and buck transformers so that the sum of their secondary voltages either boosts or bucks the input. The ratio of output to input is determined by the relative time the circuit in the boost or buck states. Switching in of the present invention circuit is accomplished at 20 kilohertz (50 hertz power), 24 kilohertz (60 hertz power), or 48 kilohertz (400 hertz power).

Additionally, input and output filtering in the present invention is relatively simple because the switching frequency is very high with respect to the power frequency. Relatively low values of inductors are required in the filters so that the regulator internal impedance is low. Also, the filters need low capacitance so that there can be used dry type capacitors rather than oil filled capacitors in the filter of the present invention.

The present invention does not require a power transformer to provide boost and buck voltage sources, nor to provide isolation between input and output. Consequently, the size, weight and cost of a power transformer are omitted from the present invention.

Additionally, currently available field effect-transistors have limited power handling capability, so that a much greater power is provided by the regulator of the present invention in comparison to that utilizing field effect-transistors with the present state of the art.

I claim:

1. An AC voltage regulator having input terminals for receiving an input voltage having a predetermined frequency, and output terminals for discharging an instantaneously-regulated output voltage, said AC voltage regulator comprising:

means for generating an AC reference voltage signal which has a frequency equal to the frequency of the input voltage, which is in phase with the input voltage, and which has a predetermined amplitude proportional to a predetermined, desired output voltage;

comparing means for instantaneously comparing said AC reference voltage signal to a portion of the instantaneously-regulated output voltage to determine an error between the instantaneously-regulated output voltage and said predetermined, desired output voltage; and means for instantaneously correcting said error by altering said instantaneously-regulated output voltage to conform to said predetermined, desired output voltage.

2. The AC voltage regulator of claim 1, wherein said comparing means comprises:

means to convent said AC reference voltage signal to a pulsating DC reference voltage signal and to convert said portion of said instantaneously-regulated output voltage to a pulsating DC output voltage signal; and means to instantaneously compare, point-to-point, said pulsating DC reference voltage signal to said pulsating DC output voltage signal.

3. The AC voltage regulator of claim 2, wherein said converting means comprises a precision rectifier circuit.

4. The AC voltage regulator of claim 2, wherein said means for instantaneously correcting said error comprises:

boost transformer means;

buck transformer means;

switching means controlling said boost transformer means and said buck transformer means; and means for producing driving signals which are proportional to said error, said driving signals driving said switching means.

5. The AC voltage regulator of claim 4, further comprising synchronization means to synchronize said switching means with said input voltage.

6. The AC voltage regulator of claim 4, wherein said means for producing driving signals comprises a pulse width modulator which instantaneously compares said pulsating DC reference voltage signal to said pulsating DC output voltage signal, said driving signals comprising pulses having a width which is proportional to said error.

7. The AC voltage regulator of claim 6, wherein said means for producing driving signals further comprises a pulse-timing circuit.

8. The AC voltage regulator of claim 4, wherein said boost transformer means and said buck transformer means are switched at a frequency which is an integral multiple of the frequency of the input voltage.

9. The AC voltage regulator of claim 4, further comprising:

input filtering means electrically connected across said input terminals; and output filtering means electrically connected across said output terminals.

10. The AC voltage regulator of claim 9, wherein:

said boost transformer means comprises a primary winding and a secondary winding;

said buck transformer means comprises a primary winding and a secondary winding;

said switching means comprises a first switch means and a second switch means;

the secondary winding of the boost transformer means and the secondary winding of said buck transformer means are electrically connected in series between said input filtering means and said output filtering means;

the first switch means is electrically connected in series with said second switch means;

the first switch means is electrically connected in series with the primary winding of said buck transformer means, and is electrically connected in parallel with the primary winding of said boost transformer means; and the second switch means is electrically connected in series with the primary winding of said boost transformer means, and is electrically connected in parallel with the primary winding of said buck transformer means.

11. The AC voltage regulator of claim 10, wherein:

said first switch means comprises at least one transistor driven by said driving signals; and said second switch means comprises at least one transistor driven by said driving signals.

12. The AC voltage regulator of claim 10, further comprising means to prevent said first switch means from being off simultaneously with said second switch means.

13. The AC voltage regulator of claim 10, further comprising:

start-up circuit means electrically connected in series between an output terminal of said input filtering means and said first switch means, and electrically connected in series between said output terminal of said input filtering means and the primary winding of said boost transformer means.

14. The AC voltage regulator of claim 4, further comprising amplifying means to amplify said driving signals.

15. The AC voltage regulator of claim 14, wherein said amplifying means comprises:

optical isolator circuit means for receiving said driving signals;

power buffer means electrically connected in series to said optical isolator circuit means;

speed-up circuit means electrically connected in series to said power buffer means;

protection circuit means electrically connected in series to said speed-up circuit means; and common-mode filter means electrically connected in series to said protection circuit means.

16. The AC voltage regulator of claim 11, wherein said means for generating an AC reference voltage signal comprises:

digital filter means for filtering a first voltage signal having a frequency equal to the frequency of the input voltage and which is in phase with the input voltage;

an analog multiplier means having a first input terminal electrically connected to said digital filter means;

a transformer means having a primary winding and a secondary winding, said primary winding being electrically connected to said analog multiplier means;

a precision RMS-to-DC converter means electrically connected between the secondary winding of said transformer means and a DC comparing means for comparing an output of said precision RMS-to-DC converter means to a DC reference voltage, said DC comparing means being electrically connected to a second input terminal of said analog multiplier means.

17. The AC voltage regulator of claim 1, further comprising an output voltage transformer means, having a primary winding electrically connected across said output terminals, for generating said portion of said instantaneously-regulated output voltage.

* * * * *